United States Patent [19]

Knickerbocker

[11] 4,000,799

[45] Jan. 4, 1977

[54] COIN TOTALIZER MECHANISM

[76] Inventor: Karl Knickerbocker, 400 Baycrest Drive, Venice, Fla. 33595

[22] Filed: Jan. 12, 1976

[21] Appl. No.: 648,573

[52] U.S. Cl. ..... 194/1 L
[51] Int. Cl.[2] ..... G07F 5/08
[58] Field of Search ..... 194/51, 65, 1 G, DIG. 2, 194/DIG. 3, 2, 94, 1 L

[56] References Cited

UNITED STATES PATENTS

| | | | |
|---|---|---|---|
| 3,738,466 | 6/1973 | Knickerbocker | 194/1 L |
| 3,946,848 | 3/1976 | Knickerbocker | 194/1 L |

*Primary Examiner*—Stanley H. Tollberg
*Attorney, Agent, or Firm*—Arthur W. Fisher, III

[57] ABSTRACT

A coin controlled mechanism for use with a dispensing device having an access door including latch operatively controlled by the coin controlled mechanism wherein the coin controlled mechanism comprises a totalizer including a totalizer operator, totalizer register and totalizer actuator to calculate the cumulative total of coins fed to the coin controlled mechanism and totalizer control including an actuator stop and stop actuator to control the incremental advance of the totalizer, a coin chute comprising a single coin passage to control the coins, a totalizer lock to prevent inadvertent actuation of the totalizer and totalizer release and reset to release the totalizer lock and reset the totalizer register and operator. The totalizer actuator and coin chute being arranged relative to one another such that coins passing through the coin chute engage the totalizer actuator to incrementally advance the totalizer operator and register in response to coins whereby the latch is released upon totalizing or calculating a predetermined price total.

24 Claims, 8 Drawing Figures

FIG. 1
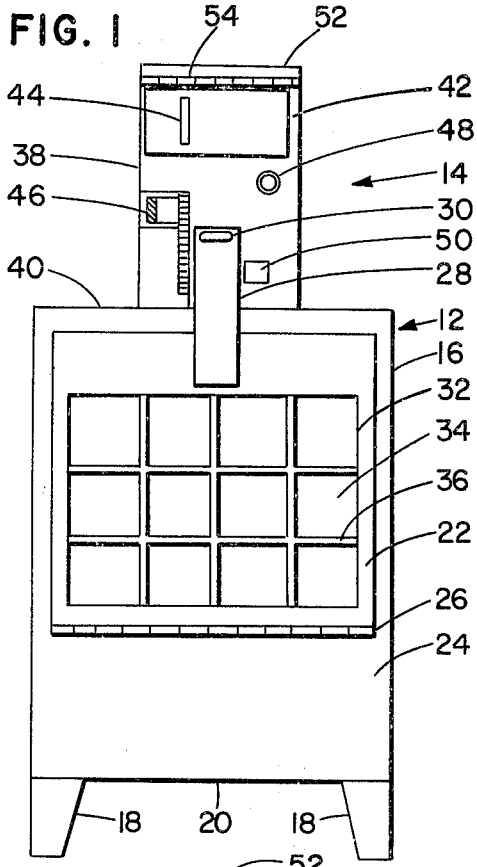
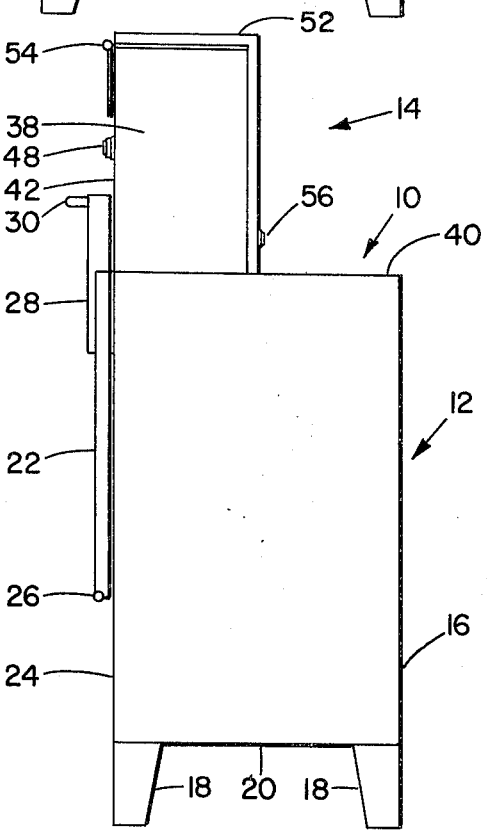
FIG. 2
FIG. 7
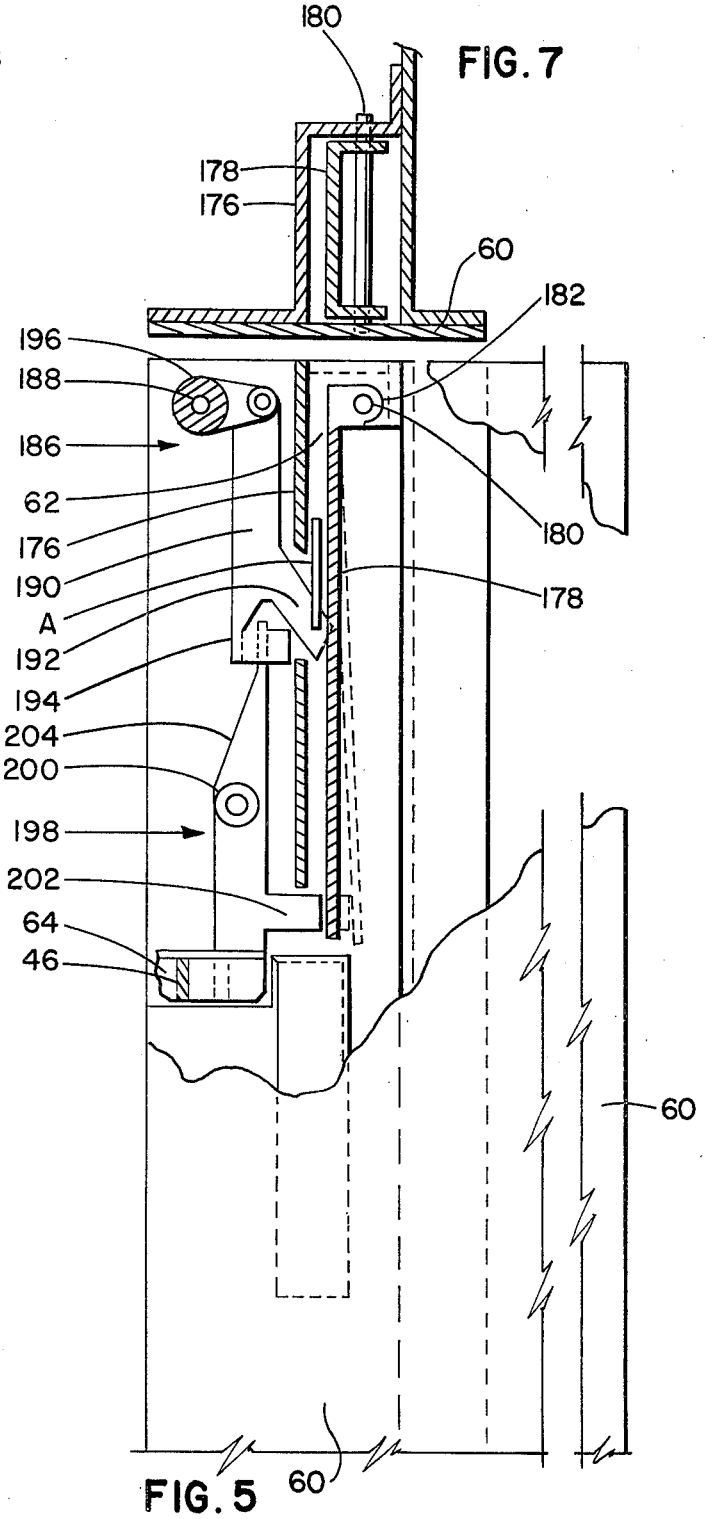
FIG. 5

COIN TOTALIZER MECHANISM

BACKGROUND OF THE INVENTION

1. Field of the Invention

A coin controlled mechanism for use in combination with a dispensing device wherein the coin controlled mechanism includes a totalizer means to calculate the cumulative value of coins inserted therein to control the dispensing device.

2. Description of the Prior Art

A great many newspaper racks, cigarette machines and the like have been developed to provide a means of vending such items without the necessity of an attendant.

Today, most such machines include mechanisms for controlling the door or other dispensing element to permit opening the door only after the proper number of coins have been deposited in the machine. These machines may be mechanical, electro-mechanical or electrical.

Many of the more advanced mechanical dispensing devices comprise a coin operated dispensing mechanism in which the proper combination of coins must be deposited in a coin chute to prevent the upward movement of the coins in the chute to thereby operate a latch actuated by movement of the dispensing element which releases the latch. When an improper combination of coins is present, upward movement of the coins prevents the releasing of the latch. Unfortunately, in this type of a coin mechanism, inserted coins are stacked edgewise in one or more vertical coin chutes. Since the vertical length of the coin chutes are limited by allowable space, a vending machine equipped with this type of a coin mechanism will be limited to low selling prices. In addition, many such devices include a plurality of coin chutes and cradles which add significantly to manufacturing costs.

An increasing number of coin controlled, electrically operated vending machines have been constructed to vend a plurality of different kinds or brands or merchandise such as cigarettes or the like for various prices.

Electrically operated vending machines do have some advantages over mechanical vending machines. For example, mechanical machines are susceptible to abuse due to jerking and slamming which causes undue strain, frequently resulting in mechanical failure.

Unfortunately, electrical vending machines generally comprise complicated electrical circuits and electrical parts making for increased liability to failure due to short circuits or other electrical faults. In addition, in many uses electrical power is not readily available for use with these vending machines.

Thus, a need exists for a reliable mechanically operated coin controlled dispensing mechanism having the capability of registering relatively large amount of change to control the dispensing cycle in response thereto.

SUMMARY OF THE INVENTION

The present invention relates to a coin controlled mechanism for use in combination with a dispensing device having an access door including latch means operatively controlled by the coin controlled mechanism. More specifically, the coin controlled mechanism of the present invention comprises a totalizer means including a totalizer actuator means and a coin chute means arranged relative to one another such that as coins pass through the coin chute means the coins engage the totalizer actuator means to move the totalizer actuator means in response to coins whereby the latch means of the dispensing device is released upon the registering of a predetermined price total.

The totalizer means further includes a totalizer register means and totalizer operator means to calculate the cumulative value of coins inserted into the mechanism.

The coin controlled mechanism may further include a latch means to control movement of the access door, price setter means to set the price or value necessary to operate the mechanism to a predetermined setting as well as a totalizer control means to control the incremental advance of the totalizer means, totalizer lock means to prevent inadvertent actuation of the totalizer means, and totalizer release and reset means to release the totalizer lock means and reset the totalizer register and operator means respectively.

The coin chute means comprises a single coin chute including a pair of channels arranged in spaced parallel relationship relative to one another to control the passage of coins therethrough.

The price setter means includes an adjustable price setter control means to permit a rapid changing of a price selected between an upper and lower limit. This is particularly useful in the case of the newspaper vending machines wherein the price may vary from the daily to the Sunday paper.

In addition, the coin controlled mechanism includes a coin return means to permit return of coins when the latch means is not actuated. To prevent the simultaneous actuation of the latch means and the coin controlled mechanism further includes an anti-cheat means which prevents the simultaneous actuation of the coin return means and the latch control means.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a front view of a periodical dispensing device.

FIG. 2 is a side view of a periodical dispensing device.

FIG. 5 is a front view of the coin controlled mechanism.

FIG. 7 is a top end view of the coin chute means.

Similar reference characters refer to similar parts throughout the several views of the drawings.

DETAILED DESCRIPTION OF THE PREFERRED EMBODIMENT

Figure 4:
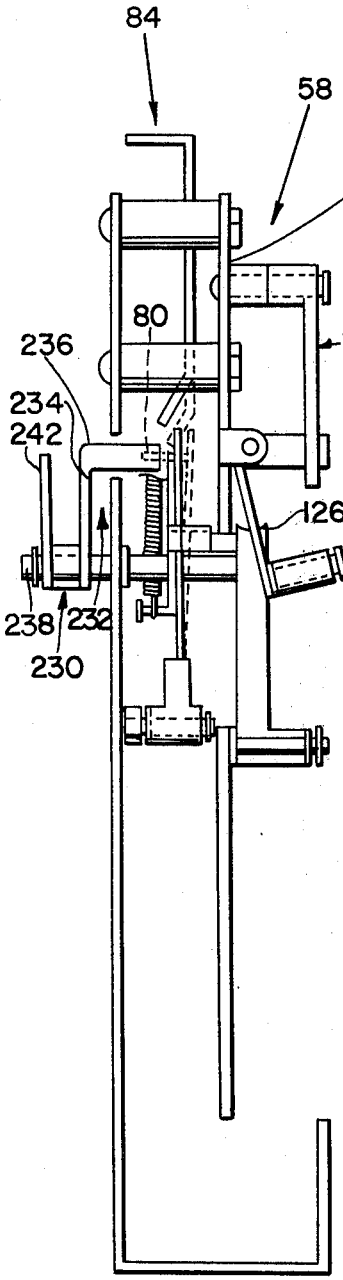
FIG. 4 is a left end view of FIG. 3 of the coin controlled mechanism.

FIGS. 1 and 2 show a coin controlled mechanism in combination with a periodical dispensing device 10.

The periodical dispensing device 10 comprises a periodical housing 12 having a coin controlled mechanism housing 14 fixedly mounted thereon. The periodical housing 12 comprises a substantially rectangular enclosure 16 supported on a plurality of support members 18 attached to the base 20 thereof. An access door 22 is pivotally attached to the front 24 of the enclosure 16 by a first hinge means 26 for loading and dispensing periodicals therethrough. The access door 22 includes an access door extension 28 having an access door extension handle 30 formed thereon. An access door window 32 comprises a transparent material to permit visual display of a periodical 34 held in place by a retainer means 36. The coin controlled mechanism housing 14 comprises enclosure 38 on the top 40 of the enclosure 16. Formed in the front 42 of the enclosure 38 are coin insert slot 44, coin return actuator 46, adjustable price setter control means 48 and coin return receiver 50. The rear and top portion 52 of the enclosure 38 is pivotally attached to the front 42 thereof by second hinge means 54 to permit access to the coin controlled mechanism. A coin controlled mechanism housing lock 56 is mounted on the housing 14 to selectively lock the rear and top portion 52 to control access to the housing 14.

As described more fully hereinafter, the coin controlled mechanism of the present invention comprises a totalizer means to calculate the cumulative value of coins inserted into the mechanism, latch means to control movement of the access door, price setter means to set the price or value necessary to operate the mechanism to a predetermined setting, totalizer control means to control the incremental advance of the totalizer means, totalizer release and reset means to release the totalizer control means and reset the latch means, and coin chute means.

Figure 3:
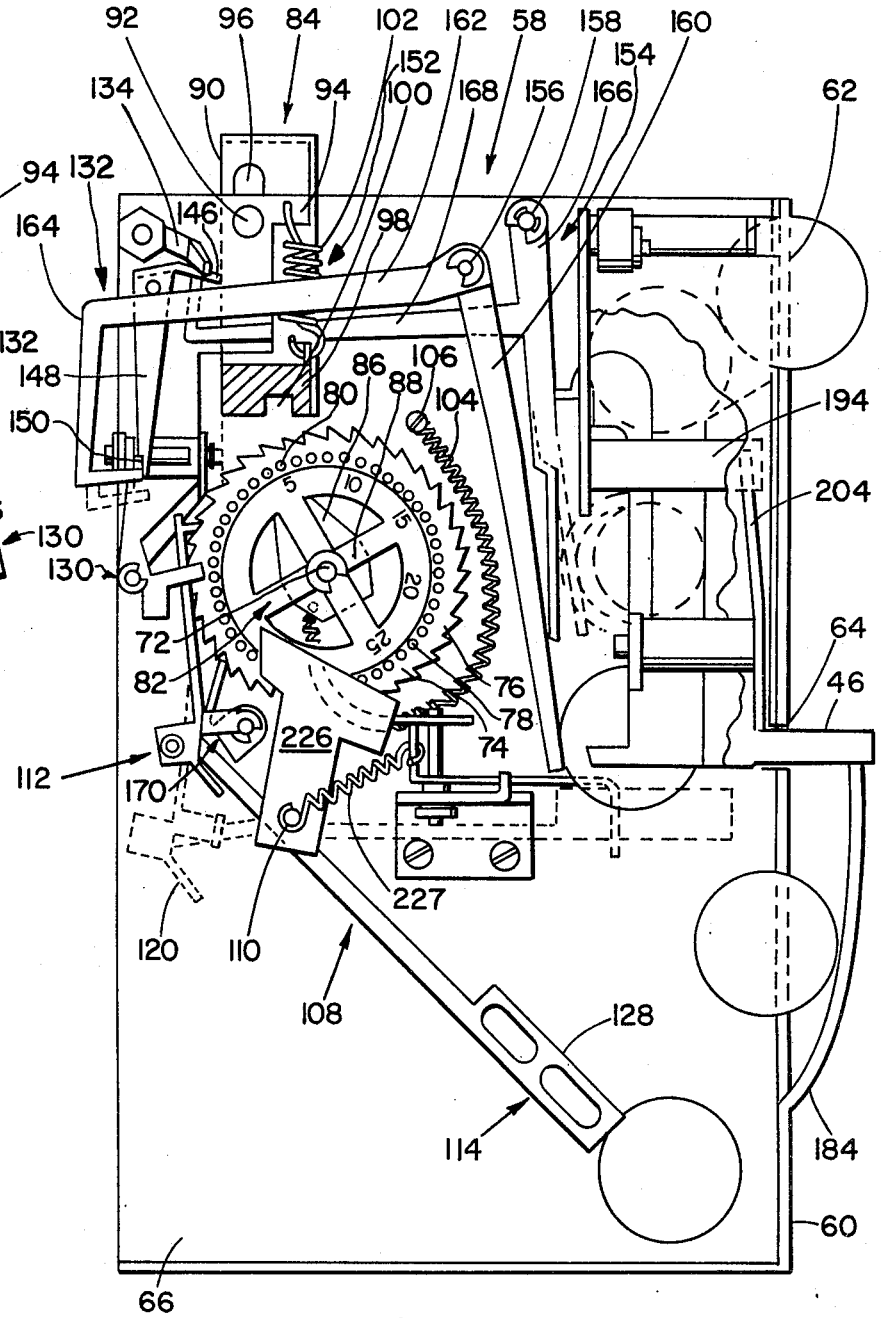
FIG. 3 is a side view of the coin controlled mechanism in the actuated position.

FIGS. 3, 4, 6 and 8 show in detail the coin controlled mechanism generally indicated as 58. As best shown in FIG. 3, the coin controlled mechanism 58 includes a mechanism base plate 60 having a base plate coin insert slot 62 and coin return actuator opening 64. A mounting plate 66 extends rearwardly from the base plate 60 to operatively support the various mechanism components as more fully described hereinafter.

Figure 6:
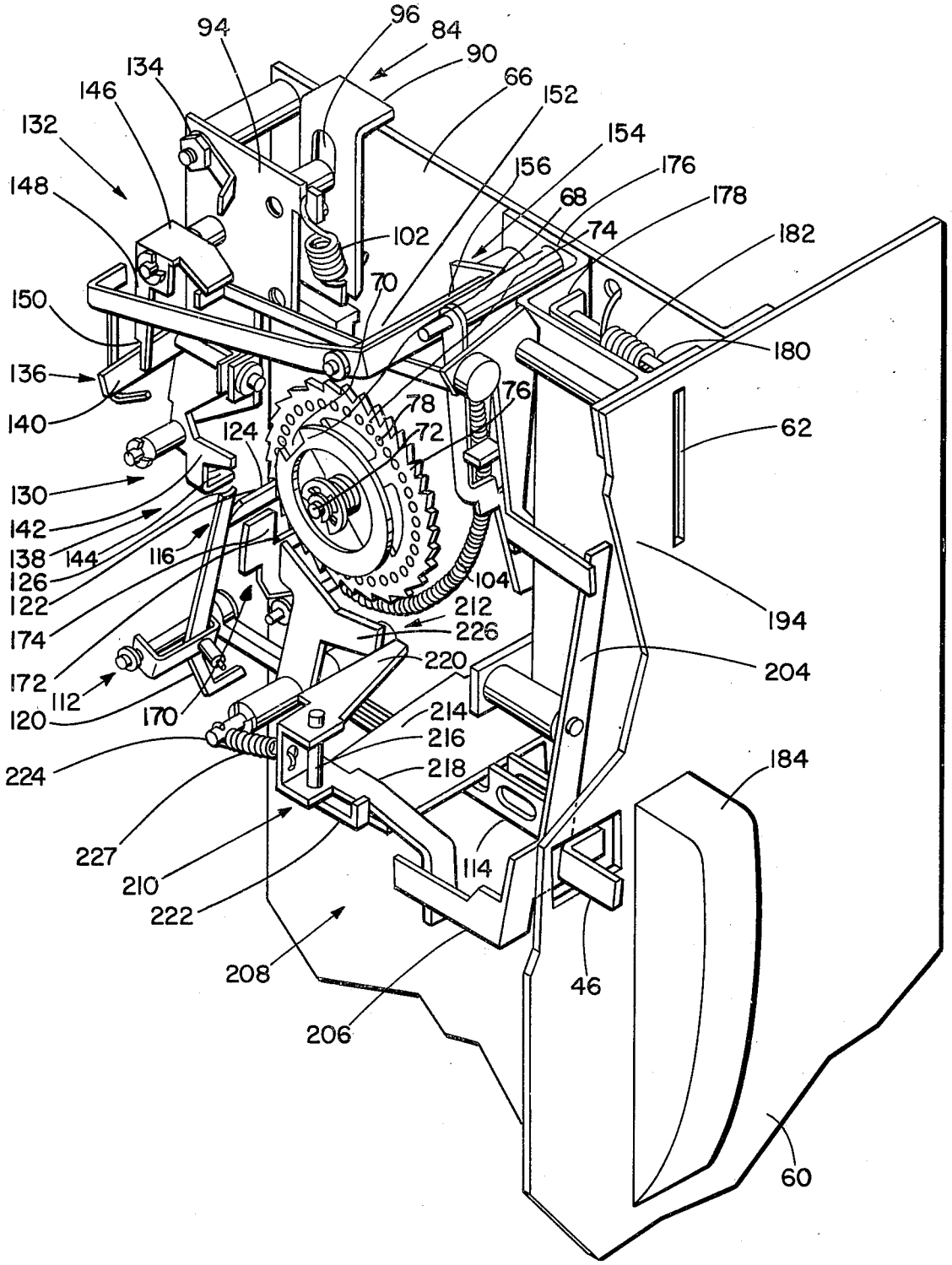
FIG. 6 is a perspective view of the coin controlled mechanism.
Figure 8:
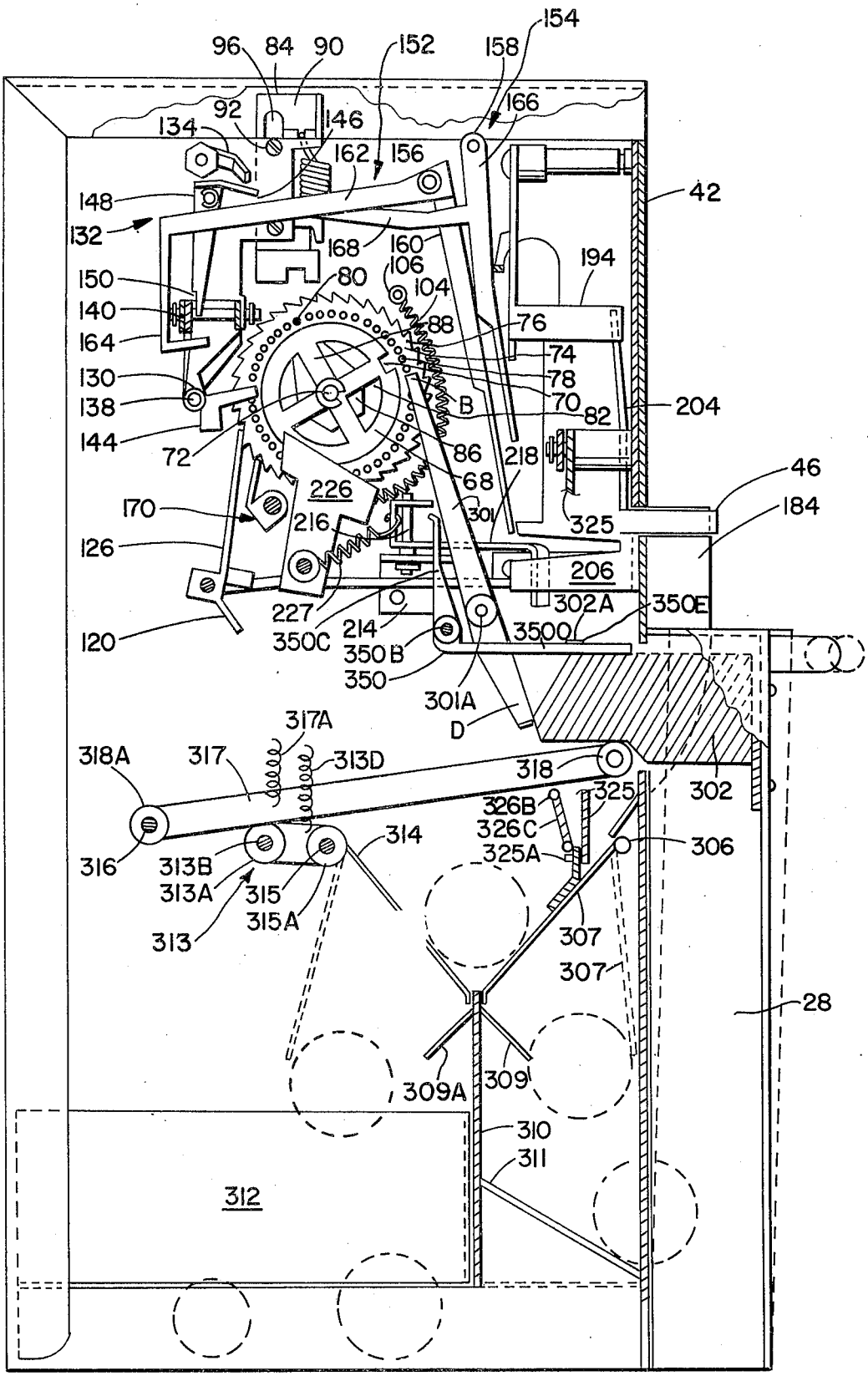
FIG. 8 is a side view of the coin controlled mechanism in the normal position.

As best shown in FIGS. 3, 6 and 8, the coin controlled mechanism 58 comprises a totalizer means and totalizer control means. The totalizer means includes a totalizer register means, totalizer operator means, totalizer actuator means and totalizer lock means. The totalizer register means comprises a circular wheel 68 having notch 70 formed in the perimeter thereof. The totalizer operator means comprises a ratchet wheel 74 rotatably mounted on shaft 72 and having a plurality of teeth 76 formed about the periphery thereof, each tooth 76 corresponding to one of the apertures 78 formed about the ratchet wheel 74. As described more fully hereinafter, each tooth 76 and aperture 78 represents a nickel value. The plurality of price setter apertures 78 cooperate with a price setter pin 80 to form a variable price setter means as more fully described hereinafter.

As shown in FIGS. 3 and 8, the price setter means comprises a variable price setter means including a price setter generally indicated as 82 and price setter adjustment means generally indicated as 84. The price setter 82 comprises fixed plate 86 and cross member 88 fixedly attached to shaft 72. The price setter pin 80 is disposed on the price setter plate 86 to selectively engage one of the plurality of apertures 78. The adjustment means 84 comprises movable plate 90 movably mounted on elements 92 which extend from plate 94. Elements 92 extend through elongated slot 96 to permit vertical movement of plate 90 as described more fully hereinafter. The lower portion of plate 90 includes a bifurcated element 98 having notch 100 formed therein to engage plate 86 to permit adjustment of the price setter. Specifically, plate 90 is pushed downward to engage fixed plate 86 separating ratchet wheel 74 from the price setter 82 withdrawing pin 80 from aperture 78 to permit rotation of the ratchet wheel 74 and circular wheel 68 relative thereto. When the appropriate aperture 78 is opposite pin 80 plate 90 is released permitting the pin 80 to extend therethrough to lock the price setter 82 to the ratchet wheel 74 and the circular wheel 68. The adjustment means 84 is biased in an upward or first position by bias means 102 attached between the plate 94 and the lower portion of plate 90. As shown, the circular wheel 68, ratchet wheel 84 and price setter 82 when operatively coupled on shaft 72 are biased in the counterclockwise position by a second bias means 104 attached to the plate 86 on one end and mounted on mounting stud 106 at the opposite end.

The totalizer actuator means comprises a walking beam generally indicated as 108 which is pivotally mounted on mounting plate 66 by actuator shaft 110. As best shown in FIG. 6, a ratchet actuating pawl 112 is pivotally attached to one end of beam 108 while a coin receiver generally indicated as 114 is formed on the opposite end thereof. The ratchet actuating pawl 112 comprises a multiple step element 116 to selectively engage the totalizer operator means 74 and totalizer control means as more fully described hereinafter, and a counterweight 120. Multiple step element 116 comprises first, second and third step portion 122, 124 and 126 respectively. The coin receiver 114 comprises an open end channel formed by substantially parallel receiver elements 128 disposed on opposite sides of the walking beam 108. (FIG. 3).

It should be noted that the lower portion of element 144 rotates to force stepped portion 124 into the teeth 76 to prohibit improper advance of the ratchet wheel 74 and circular wheel 68.

As best shown in FIGS. 3, 6 and 8, the totalizer control means comprises an actuator stop means and a stop actuator means. The actuator stop means comprises first, second and third actuator stops 130, 132 and 134 respectively (FIG. 6). First actuator stop 130 comprises a first upper element 136 pivotally mounted on plate 94 and a first lower element generally indicated as 138. The first lower element 138 is pivotally mounted to rotate parallel to plate 66. The upper element 136 rotates 90° therefrom. The upper element comprises bar 140 disposed to engage second actuator stop 132 as more fully described hereinafter. The first lower element 138 comprises a first member 142 disposed to engage the multiple step element 116 as previously described and second member 144 to engage the totalizer lock means to lock multiple step element against the ratchet wheel 84 to prevent improper advance. The second actuator stop 132, pivotally mounted on plate 94, comprises second upper element 146 and second lower element 148 having notch 150 formed thereon to engage bar 140 as more fully descibed hereinafter. The third actuator stop 134 is fixedly attached to plate 94 to selectively engage second upper element 146 as more fully described hereinafter. As best shown in FIG. 3, the stop actuator means comprises a first and second stop actuators 152 and 154 respectively. First stop actuator 152, pivotally mounted on shaft 156 comprises a first, second and third member 160, 162 and 164 respectively. First stop actuator 152, pivotally mounted on shaft 156 comprises a first, second and third member 160, 162 and 164 respectively. The second stop actuator 154 pivotally mounted on shaft 156, comprises first and second members 166 and 168 respectively. The lower portion of member 160 and 166 are enlarged to selectively engage the coins from the coin chute as more fully described hereinafter.

The totalizer lock means generally indicated as 170 rotatably mounted on plate 66 comprises a lock member including stepped portions 172 and 174. First stepped portion 174 is disposed to engage the ratchet wheel 74 and while second stepped portion 172 is disposed to engage the reset and release mechanism as more fully described hereinafter.

As best shown in FIGS. 5 and 7, the coin chute means comprises a pair of substantially parallel channels 176 and 178. As shown therein, channel 176 is affixed to base plate 60 while channel 178 is pivotally mounted on the base plate 60 by shaft 180 and biased in the normal or first position by bias means 182 as best shown in FIG. 7. The channels 176 and 178 extend from the coin insert slot 44 vertically downward to direct the coins to the coin receiver 114. The coin receiver 114 and parallel channels 176 and 178 are disposed immediately rearward of coin housing 184 formed on base plate 60 to control the movement of the coins through the means as more fully described hereinafter. The coin chute means further includes a penny catcher generally indicated as 186, the penny catcher 186 is pivotally mounted on plate 60 by shaft 188. The penny catcher 186 comprises substantially catch member 190 terminating in catch tip 192 to physically catch the pennies shown as A by virture of its specific shape. The lower portion includes first catch release element 194 while the upper portion includes a counterweight 196 to maintain the penny catch 186 in operative position. A coin return means generally indicated as 198 is pivotally attached to plate 60 by shaft 200. The coin return 198 includes bent coin release element 202 disposed to engage channel 178 to separate it away from channel 176 to permit the return of bent coins caught in the coin slot itself. Further, the upper portion of second catch release element 204 is disposed to engage the first catch release element 194 to permit the return of pennies caught by penny catcher 186. The coin return mechanism further includes totalizer release and reset element 206 to operatively and selectively engage the coin release and reset means generally indicated as 208. The coin release and reset means 203 comprises a first and second release and reset element 210 and 212 as best shown in FIG. 6. The first release and reset element 210 is pivotally mounted on mounting plate 214 by shaft 216 and includes first release and reset member 218, second release and reset member 220 and stop member 222. The second release and reset element 212 is pivotally attached or mounted on shaft 224 and includes a release and reset member 226 disposed to engage the totalizer lock means as more fully described hereinafter. The first release and reset element 210 is biased in the first position by bias means 227 attached between shaft 224 and element 210. Member 218 is disposed to selectively engage element 206 as more fully described hereinafter. Specifically, actuation of coin return actuator 46 moves totalizer release and reset element 206 attached thereto pivoting first release and reset element 210 rotating release and reset member 226 against totalizer lock means 170 out of engagement with ratchet wheel 74 returning the ratchet wheel 74 to its origin under the influence of bias means 104.

As shown in FIG. 4, the adjustable price setter control means permits adjustment for either a high or low preselected limit. The adjustable price setter control means 230 comprises a stop element 232 including actuator 234 terminating in plate 236 pivotally mounted on shaft 238. Plate 236 is disposed to engage the pin 80 to move between a first and second position. The actuator 234 is coupled to price setter control means 48 by interconnecting element 242.

As best shown in FIG. 8, the coin controlled mechanism further includes a latch means comprising a latch plate 302 including latch plate hook 302-A attached to the interior of the door extension 28 and catch means generally indicated as 350 pivotally mounted on shaft 350-B. Catch means 350 includes substantially vertical member 350-C and substantially horizontal member 350-D along with an aperture 350-E disposed to selectively engage latch plate hook 302-A to normally lock the door 22. A dispenser actuator means 301 is pivotally mounted on mounting plate 66 by shaft 301-A and includes upper element B and lower element D. As shown, the dispenser actuator means 301 is disposed to operatively engage catch means 350 to permit selective opening of access door 22.

As best shown in FIG. 8, the coin controlled mechanism further includes a coin escrow having a coin deposit and coin return means. The coin deposit means includes a first coin deposit element 317 pivotally mounted on mounting plate 66 by shaft 316 and bushing 318-A. Disposed at the opposite end thereof is a roller means 318 to operatively engage latch plate 302 as more fully described hereinafter. The coin deposit further includes a second coin deposit element generally indicated as 313 pivotally attached to mounting plate 66 by shaft 315 and bushing 315-A. Disposed to the opposite end thereof is a roller means 318 to operatively engage latch plate 302 as more fully described hereinafter. Disposed to the opposite end thereof is a bushing 313-A mounted on shaft 313B. Fixedly attached to shaft 315 is a coin deposit door 314. The first and second coin deposit members 317 and 313 are biased upwardly by bias means 317-A and 313-D, respectively, each interconnected to the mounting plate 66. The coin return means includes coin return member 325 coupled at its upper end to second catch release element 204 and at the lower end to bias 326-C. Coin return element 325-A is fixedly attached to a coin return door 307. Disposed immediately between door 314 and 307 is separator wall 310, having deflector plates 309 and 309-A extending outwardly therefrom. Coin return means further includes lower deflector plate 311. A coin deposit hopper 312 is disposed below coin deposit door 314.

In operation, as coins are inserted through coin insert slot 44 they fall downward through the upper portion of the coin chute means. As a nickel passes downward through the coin chute means, the nickel engages the lower portion of the first member 160 actuating first stop actuator 152 causing it to rotate upwardly rotating bar 140 outwardly to engage stop means 150. Simultaneously, as the nickel passes downwardly it is caught in coin receiver 114 rotating ratchet actuating pawl 112 moving it upwardly causing step portion 124 to engage the ratchet wheel 84 advancing ratchet wheel 84 in a clockwise direction. As ratchet actuator pawl 112 moves upwardly, step portion 126 engages first actuator stop 130 which as previously described is rotated outwardly under the influence of first stop actuator 152. The upward movement of first upper element 140 engages notch 150 limiting the movement of actuator 112 to cause ratchet wheel 74 and circular wheel 68 to advance one increment. In the case of a dime, the dime is inserted through slot 44 travels downward through the coin chute and similarly resets in channel 114 moving actuator 112 upwardly whereby step 122 engages element 142 to advance the ratchet wheel 74 and circular wheel 68 two increments. Upon inserting a quarter through coin insert slot 44, it similarly travels downward through the upper portion of the coin chute and rests in receiver 114 moving element 112 upwardly and advancing the ratchet wheel 74 and circular wheel 68. Simultaneously, the quarter engages member 166 of second stop actuator 154 and member 160 of first stop actuator 152 causing each to rotate upwardly. Second stop actuator 154 engages second actuator stop 132 rotating it upwardly to engage third stop actuator 134. Simultaneously, the first stop actuator 152 rotates first actuator stop 130 upwardly and outwardly causing step portion 126 to engage element 142 as it moves upwardly permitting the ratchet wheel 74 and circular wheel 68 to advance five increments. In this position, coins are permitted to roll freely from 114 through coin housing 134 to the lower portion of the coin totalizer mechanism where they are dopped between coin deposit door and coin return door 307.

Normally, element B of dispenser actuator 301 engages the periphery of the totalizer operator means 122. This engagement between the dispenser actuator 301 and the periphery of totalizer operator means 122 prevents the outward movement of access door 22 relative to the housing 12. However, when a sufficient number of coins are deposited as determined by the price setter, the door 22 may be opened permitting B to enter into the notch 70 on the circular wheel 68 causing dispenser actuator member 301 to rotate in a counterclockwise direction permitting D to ride free of latch plate 302. Thus, members 317 and 313 are permitted to move upward under bias influence of 317-A and 313-D respectively. As a result, door 314 is permitted to move downwardly depositing the coin in coin hopper 312. Upon closing the door 22, the latch plate 302 rides over roller 318 forcing members 317 and 313 to return to their normal position closing door 314. Simultaneously, the inner portion of the latch plate 302 engages element D rotating element B from the notch 70 and permitting the coin return release to return the totalizer to the original position. Alternately, the coin return actuator means may be actuated by moving coin return actuator 46 rotating 325 which in turn swings coin return door 307 to the open position to return the coins to the coin return receiver 50. Upon release of the actuator 46, the door 307 is closed under the influence of spring 326-C.

It will thus be seen that the objects set forth above, among those made apparent from the preceding description, are efficiently attained, and, since certain changes may be made in the above construction without departing from the scope of the invention, it is intended that all matter contained in the above description, or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A coin controlled mechanism including a coin controlled mechanism housing for use in combination with a dispensing machine including an access door having a latch means attached to permit dispensing of products from the dispensing machine upon receipt of a predetermined amount of coins in said coin controlled mechanism, said coin controlled mechanism comprising a totalizer means including a totalizer register means and a coin chute means, said totalizer register means including a dispenser actuator means, said dispenser actuator means and said latch means each movable between a dispensing and non-dispensing position, said totalizer means also including a totalizer operator means operatively interconnected to said totalizer register means, said dispenser actuator means disposed to engage said latch means to control movement of said latch means from said non-dispensing to said dispensing position, said totalizer means including a totalizer actuator means, said totalizer actuator means movable between a first and second position in response to coins passing through said coin chute means, said totalizer actuator means disposed to selectively engage said totalizer operator means to control movement thereof in response to coins passing through said coin chute means and a totalizer control means comprising a first actuator stop means having a first position disposed to engage said totalizer actuator means to control movement thereof, said coin chute means comprising a single coin passage to control the travel of coins inserted therein, said first actuator stop means being disposed to engage said totalizer actuator means when in said first position in response to coins passing through said coin chute means to selectively control the extent of movement of said totalizer operator means and said totalizer register means relative to said dispenser actuator means to control said latch means whereby said totalizer means advances incrementally to permit movement of said latch means to said dispensing position when the proper combination of coins is registered by said totalizer register means.

2. The coin controlled mechanism of claim 1 wherein said totalizer actuator means comprises a beam pivotally mounted in said coin controlled mechanism housing, said beam movable between a first and second position, said beam having an actuating pawl formed on one end thereof and a coin receiver formed on the opposite end thereof, said coin receiver disposed to receive coins fed through said coin chute means, said actuating pawl disposed to selectively engage said totalizer operator means in response to coins received in said coin receiver when said beam is in said second position to advance said totalizer operator means and said totalizer register means.

3. The coin controlled mechanism of claim 2 wherein said actuating pawl comprises a multiple step element including a first and second step portion, said first step portion to selectively engage said totalizer control means and said second step portion disposed to selectively engage said totalizer operator means when said beam is in said second position to advance said totalizer operator means and said totalizer register means a first predetermined number of increments.

4. The coin controlled mechanism of claim 2 wherein said coin receiver comprises an open end channel formed by substantially parallel receiver elements disposed on opposite sides of said beam.

5. The coin controlled mechanism of claim 4 wherein said coin controlled mechanism housing includes a coin housing formed therein, said coin housing disposed adjacent to the open end of said open end channel to feed coins therefrom to a coin escrow as said beam moves from said first to said second position.

6. The coin controlled mechanism of claim 1 further including a price setter means and price setter adjustment means, said price setter means disposed to engage said totalizer operator means to control the proper combination of coins to operate said coin controlled mechanism and said price setter adjustement means disposed to selectively engage said price setter means to adjustably vary the proper combination of coins to operate said coin controlled mechanism.

7. The coin controlled mechanism of claim 1 wherein said totalizer register means comprises a substantially circular wheel having a notch formed on the periphery thereof and said totalizer operator means comprises a ratchet wheel having a plurality of teeth formed on the periphery thereof, said totalizer register means and said totalizer operator means operatively interconnected and rotatably mounted on said coin controlled mechanism housing.

8. The coin controlled mechanism of claim 7 further including a price setter means disposed to engage said totalizer operator means to control the proper combination of coins to operate said coin controlled mechanism, said price setter adjustment means disposed to selectively engage said price setter means to adjustably vary the proper combination of coins to operate said coin controlled mechanism.

9. The coin controlled mechanism of claim 8 wherein said price setter means comprises a fixed plate attached to a shaft rotatably mounted in said coin controlled mechanism housing, said totalizer operator means and said totalizer register means being rotatably mounted on said shaft, said fixed plate having a price setter pin formed thereon and said totalizer operator means having a plurality of apertures formed thereon, said fixed plate being disposed relative to said totalizer operator means such that said price setter pin selectively engages one of said plurality of apertures to operatively couple said price setter means to said totalizer operator means and said totalizer register means.

10. The coin controlled mechanism of claim 9 further including price setter adjustment means, said price setter adjustment means disposed to selectively engage said price setter means to adjustably vary the proper combination of coins to operate said coin controlled mechanism, said price setter adjustment means comprises a plate including a bifurcated element formed on one end thereof, said plate movable between a first and second position, said plate being disposed to engage said fixed plate when in said second position to permit rotation of said totalizer operator means and totalizer register means relative to said price setter means to adjust the proper coin combination to operate said coin controlled mechanism.

11. The coin controlled mechanism of claim 1 wherein said first actuator stop means is movable between a first and second position, said totalizer control means further includes a first stop actuator means movable between a first and second position disposed in operative relation to said first actuator stop means and disposed to engage coins inserted into said coin chute means to control movement of said first actuator stop means to said second position when said first stop actuator means is in said second position to limit movement of said totalizer operator means to said totalizer register means to a second predetermined number of increments.

12. The coin controlled mechanism of claim 11 wherein said totalizer control means further includes a second actuator stop means movable between a first and second position and a second stop actuator means movable between a first and second position, said second stop actuator means disposed in operative relation to said second actuator stop means and disposed to engage coins inserted into said coin chute means to control movement of said second actuator stop means to said second position when said second stop actuator means is in said second position to limit movement of said totalizer operator means and totalizer register means to a third predetermined number of increments.

13. The coin controlled mechanism of claim 11 wherein said first actuator stop means includes a first lower element disposed to engage said totalizer actuator means to prevent improper advance of said totalizer operator means and said totalizer register means.

14. The coin controlled mechanism of claim 1 wherein said totalizer control means comprises a first, second and third actuator stop means and a first and second stop actuator means, said first and second stop actuator means each having a first and second position, said first stop actuator means being disposed relative to said coin chute means to engage coins of a first predetermined dimension passing therethrough, said engagement moving said first stop actuator means from said first to said second position, said first actuator stop means disposed to engage said first stop actuator means when in said second position to move said first actuator stop means from said first to said second position to engage said totalizer actuator means to limit the movement thereof to a second predetermined number of increments, said second stop actuator means being disposed relative to said coin chute means to engage coins of said second predetermined dimension passing therethrough, said engagement moving said first and second stop actuator means from said first to said second positions, said second actuator stop means disposed to engage said second stop actuator means when in said second position to move said second actuator stop means from said first to said second position to engage said totalizer actuator means to limit the movement thereof to a third predetermined number of increments, said first and second actuator stop means each normally in said first position to engage said totalizer actuator means when coins of a third predetermined dimension pass through said coin chute means to limit the movement of said totalizer means to said first predetermined number of increments.

15. The coin controlled mechanism of claim 1 wherein said totalizer control means comprises a first, second and third actuator stop means and a first and second stop actuator means, said first stop actuator means having a first, second and third position and said second top actuator means having a first and second position, said first actuator stop means movable between a first, second and third position in response to operation of said first stop actuator means, said second actuator stop means movable between a first and second position in response to operation of said second stop actuator means, said third stop means having a first position, said first stop actuator means being disposed relative to said coin chute means to engage coins of a first or second predetermined dimension passing therethrough, said second stop actuator means being disposed realtive to said coin chute means to engage coins of said second predetermined dimension passing therethrough, said engagement of said first stop actuator means with coins of said first predetermined dimension moving said first stop actuator means from said first to said second position, said first actuator stop means disposed to engage said first stop actuator means when in said second position to move said first actuator stop means from said first to said second position to engage said totalizer actuator means, said second actuator stop means being disposed to lock said first actuator stop means in said second position when said second actuator stop means is in said first position to limit the movement of said totalizer actuator means to a second predetermined number of increments; said engagement of said second stop actuator means with coins of said second pedetermined dimension moving said second stop actuator means from said first to said second position; said engagement of said first stop actuator means with coins of said second predetermined dimension moving said first stop actuator means from said first to said third position, said second actuator stop means disposed to engage said second stop actuator means when in said second position to move said second actuator stop means from said first to said second position, said first actuator stop means disposed to engage said first stop actuator means when in said third position to move said third position to engage said totalizer actuator means, said third actuator stop means being disposed to lock said second actuator means in said second position when said third actuator means is in said first position and said second actuator stop means being disposed to lock said first actuator means in said third position when said second actuator stop means is in said second position to limit the movement of said totalizer actuator means to a third predetermined number of increments, said first, second and third actuator stop means each normally in said first position to engage said totalizer actuator means when coins of a third predetermined dimension pass through said coin chute means to limit the movement of said totalizer means to said first predetermined number of increments.

16. The coin controlled mechanism of claim 15 wherein said totalizer actuator means includes an actuating pawl movable between a first and second position, said actuating pawl comprising a multiple step element having a first, second and third step portion, said first step and third portion to selectively engage said totalizer control means and said second step portion disposed to selectively engage said totalizer operator means when said actuating pawl is in said second position to advance said totalizer operator means and said totalizer register means, said actuating pawl disposed relative to said totalizer control means to engage such that said first step portion engages said first actuator stop means when in said first position and said third step portion engages said first actuator stop means when in said second or third position

17. The coin controlled mechanism of claim 1 wherein said latch means comprises a latch plate and a latch plate hook fixedly attached to the interior of the access door and catch means movable between a dispensing and non-dispensing position including an aperture formed thereon to normally engage said latch plate hook to lock the access door, said dispenser actuator means disposed to operatively engage said catch means to permit selective opening of the access door, said dispenser actuator means movable between a dispensing and non-dispensing position, said dispenser actuator means disposed to engage the access door when closed to hold said catch means in the non-dispensing position and to disengage the access door when the predetermined number of coins are inserted into said coin controlled mechanism to move said catch means to the dispensing position to permit opening of the access door.

18. The coin controlled mechanism of claim 17 wherein said dispenser actuator means comprises a bar having an upper element disposed to engage the periphery of said totalizer register means to normally retain said dispenser actuator means in said non-dispensing position, and a lower element formed on the opposite end thereof disposed to engage said latch plate to normally hold said catch means in said non-dispensing position, said upper element of said dispenser actuator means disposed to enter into said totalizer register notch means when a predetermined value of coins is registered by said totalizer means to permit movement of said dispenser actuator means to said dispensing position moving said catch means to said dispensing position permitting withdrawal of said latch hook from said catch means aperture to permit opening of the access door.

19. The coin controlled mechanism of claim 17 further including coin deposit means for receiving and storing coins when products are dispensed from the housing, said coin deposit means comprising a first coin deposit element pivotally mounted in said coin controlled mechanism housing and a second coin deposit element pivotally mounted in said coin controlled mechanism housing, said second coin deposit element having a coin deposit door attached thereto, said first and second coin deposit element movable between a first and second position, said first coin deposit element disposed to normally engage said latch plate when the access door is in the closed position to hold said first catch means in said first position, said second coin deposit element engaging said first coin deposit element to normally hold said second coin deposit element in said first position, said first deposit element engaging said latch plate to hold said first and second coin deposit elements in said first position when said door is closed and permitting said first and second coin deposit elements to move to said second positions when the access door is open to open said coin deposit door to receive coins as the product is dispensed.

20. The coin controlled mechanism of claim 19 further including a coin return means comprising a coin return member pivotally mounted in said coin control mechanism housing, said coin return member extending through said coin mechanism housing and coupled to a coin return actuator on the exterior of said coin control mechanism at one end and attached at the opposite end to a coin return door, said coin return actuator movable between a first and second position, said coin return door having a first and second position, said coin return door movable between said first and second position in response to movement of said coin return actuator from said first to said second position to return coins from said coin controlled mechanism housing.

21. The coin controlled mechanism of claim 1 further including a penny catch comprising a catch member having a catch tip formed thereon, said penny catcher disposed to engage pennies inserted into said coin chute means.

22. The coin controlled mechanism of claim 1 further including a totalizer lock means disposed to normally engage said totalizer means to lock the position thereof following each incremental advance.

23. The coin controlled mechanism of claim 22 further including a reset and release mechanism movable between a first and second position, said reset and release mechanism disposed to engage said totalizer lock means to disengage said totalizer lock means from totalizer means when said reset and release means is in said second position.

24. The coin controlled mechanism of claim 1 wherein said dispenser actuator means further includes coin return actuator means movable between a first and second position, said chute means comprising a first and second coin chute plates, said coin return actuator means including coin return control means coupled to said coin chute plates, said first and second coin chute plates being movable relative to one another by said coin return control means, said coin return actuator means further including an actuator element arranged to engage said coin chute plates when said coin return actuator means is moved from said first to second position, said totalizer coin mechanism further including a coin return door having a first and second position to engage coin return actuator means whereby movement of said coin return actuator means causes said coin return door to open.

* * * * *